US009018509B2

(12) United States Patent
Bialkowski et al.

(10) Patent No.: US 9,018,509 B2
(45) Date of Patent: Apr. 28, 2015

(54) STRINGED MUSICAL INSTRUMENT WITH AN AUXILIARY PICKUP

(71) Applicants: Jeff Bialkowski, London (CA); Jeff Lewis, London (CA)

(72) Inventors: Jeff Bialkowski, London (CA); Jeff Lewis, London (CA)

( * ) Notice: Subject to any disclaimer, the term of this patent is extended or adjusted under 35 U.S.C. 154(b) by 0 days.

(21) Appl. No.: 14/022,703

(22) Filed: Sep. 10, 2013

(65) Prior Publication Data

US 2014/0069264 A1 Mar. 13, 2014

Related U.S. Application Data

(60) Provisional application No. 61/699,504, filed on Sep. 11, 2012.

(51) Int. Cl.
*G10H 3/18* (2006.01)

(52) U.S. Cl.
CPC ..... *G10H 3/181* (2013.01); *G10H 3/182* (2013.01)

(58) Field of Classification Search
USPC ..... 84/726–728
See application file for complete search history.

(56) References Cited

U.S. PATENT DOCUMENTS

| | | | | | |
|---|---|---|---|---|---|
| 3,483,303 | A * | 12/1969 | Warner | | 84/728 |
| 4,079,652 | A | 3/1978 | Gittler | | |
| 4,143,575 | A | 3/1979 | Oliver | | |
| 4,377,101 | A | 3/1983 | Santucci | | |
| 4,408,513 | A * | 10/1983 | Clevinger | | 84/726 |
| 5,136,918 | A | 8/1992 | Riboloff | | |
| 5,977,474 | A * | 11/1999 | O'Brien | | 84/735 |
| 6,111,184 | A | 8/2000 | Cloud et al. | | |
| 8,143,509 | B1 * | 3/2012 | Robertson et al. | | 84/604 |
| 8,704,075 | B2 * | 4/2014 | Gournis | | 84/742 |
| 2005/0252363 | A1 * | 11/2005 | Rockett | | 84/723 |
| 2007/0131100 | A1 | 6/2007 | Daniel | | |
| 2007/0160220 | A1 | 7/2007 | Latshaw | | |
| 2009/0257601 | A1 | 10/2009 | Motsenbocker | | |
| 2010/0307325 | A1 * | 12/2010 | Appel | | 84/743 |

FOREIGN PATENT DOCUMENTS

| | | | |
|---|---|---|---|
| DE | 3437389 | A1 | 4/1986 |
| DE | 4101690 | A1 | 7/1992 |
| DE | 19705849 | A1 | 8/1998 |
| GB | 1062582 | A | 3/1967 |
| GB | 2288688 | A | 10/1995 |
| WO | 2004109244 | A2 | 12/2004 |

OTHER PUBLICATIONS

"Teisco", http://en.wikipedia.org/wiki/Teisco#guitars, Wikipedia.

* cited by examiner

*Primary Examiner* — Jeffrey Donels
(74) *Attorney, Agent, or Firm* — Brion Raffoul

(57) ABSTRACT

The present invention seeks to provide a stringed musical instrument, such as an electric guitar, that has certain tones separately amplified from the amplification provided by a standard electrical musical instrument configuration. Specifically, the present invention is a stringed musical instrument with an auxiliary pickup beneath and longitudinally parallel to at least one of the strings of the musical instrument. This auxiliary pickup has a corresponding auxiliary output jack for coupling to an octave pedal and to an amplifier.

18 Claims, 3 Drawing Sheets

STRINGED MUSICAL INSTRUMENT WITH AN AUXILIARY PICKUP

FIELD OF THE INVENTION

The present invention relates to a stringed musical instrument.

BACKGROUND

Stringed musical instruments have occupied a prominent position in cultures throughout the world for millennia. After the advent of electricity, musicians started to experiment with creating electrical musical instruments.

One such musical instrument, the electric guitar, was invented in the 1930's. The instrument quickly became a standard instrument for jazz musicians who wanted to amplify the sounds produced by their instruments. In the decades that followed, electric guitars and electric bass guitars became some of the most popular instruments used in pop music. Even today, the electric guitar and electric bass guitar remain crucial elements of bands worldwide.

Electric guitars work by using an electromagnetic pickup that is typically placed below the strings of the guitar. The electromagnetic pickup has a magnet that is embedded within a coil of wire.

It is known by basic scientific principles that a changing magnetic field will cause an electric field and a current flow in and around the wire. This electric field and current is typically channeled to a mini pre-amplifier that is embedded within the body of the guitar. The signal is then typically channeled to an output jack that can be coupled to an amplifier that will produce an amplified sound.

One issue that has been addressed in various ways by musicians playing electric stringed instruments is the control and adjustment of the quality of the sound that is eventually produced by the instruments. It is well known, for instance, that knobs can be added to guitars to control and adjust the tone and/or volume of the sound produced by instrument. Additionally, sound modifying pedals can be used in conjunction with suitable electronic circuitry to modify the sound produced by the guitar.

Occasionally, a musician requires a guitar that can provide a greater amplified tone from certain strings than what a standard electric guitar configuration provides. Known prior art attempts to solve this problem involve adding control knobs that can adjust the lower or higher frequency signals to be transmitted to the amplifier.

Other prior art solutions involve having to buy expensive equipment. U.S. Pat. No. 4,377,101 by Santucci discloses a "new musical instrument which comprises the features of a common six string guitar and a normal electric bass, with four strings." This solution not only produces a bulky and hard to handle musical instrument, but it also requires a sizable financial investment.

The present invention seeks to overcome the drawbacks and shortcomings of the prior art.

SUMMARY OF THE INVENTION

The present invention provides a stringed musical instrument, such as an electric guitar, that has certain tones amplified separately from the amplification provided by a standard electrical musical instrument configuration.

Specifically, the present invention is a stringed musical instrument with an auxiliary pickup beneath and longitudinally parallel to at least one of the strings of the musical instrument. This auxiliary pickup has a corresponding auxiliary output jack for coupling to an amplifier. Additionally, at least one effects unit can be placed between the auxiliary output jack and the amplifier.

This invention further amplifies certain tones produced by specific strings of the musical instrument beyond the amplification already provided by the standard pickup.

In a first aspect, the present invention provides a stringed musical instrument comprising: at least one string; at least one auxiliary electromagnetic pickup beneath and longitudinally parallel to at least one string; and at least one auxiliary output jack that is coupled to the at least one auxiliary electromagnetic pickup, wherein the auxiliary output jack is for coupling to at least one amplifier via at least one effects unit, and wherein the at least one auxiliary output jack receives signals from the at least one auxiliary electromagnetic pickup.

In a second aspect, the present invention provides a stringed musical instrument comprising: a body; a neck connected to the body; at least one string; at least one auxiliary electromagnetic pickup affixed to the guitar body, wherein the auxiliary electromagnetic pickup is beneath and longitudinally parallel to the at least one string; and at least one auxiliary output jack that is coupled to the at least one auxiliary electromagnetic pickup, wherein the auxiliary output jack is for coupling to at least one amplifier via at least one effects unit, and wherein the at least one auxiliary output jack receives signal from the at least one auxiliary electromagnetic pickup.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The present invention provides a stringed musical instrument with an auxiliary electromagnetic pickup beneath and longitudinally parallel to at least one of the strings of the instrument.

Figure 1:
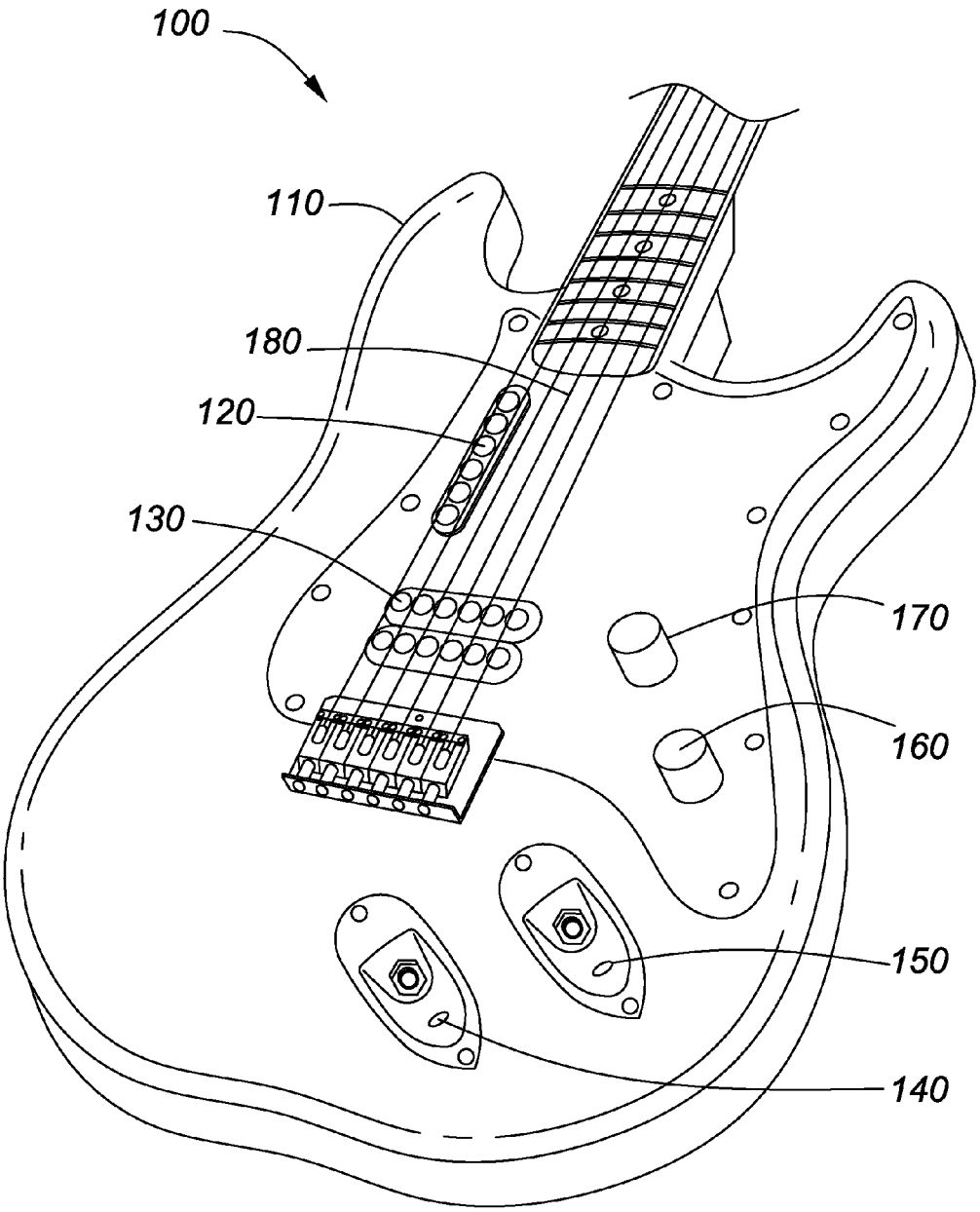
FIG. 1 is a stringed musical instrument with an auxiliary pickup beneath and longitudinally parallel to two strings according to one embodiment of the present invention.

FIG. 1 shows a stringed musical instrument 100 with an auxiliary electromagnetic pickup 120 beneath and longitudinally parallel to the strings 180 of the stringed musical instrument 100, according to one embodiment of the present invention.

Pickups longitudinally parallel to strings of stringed musical instruments are more sensitive and produce more precise signals than pickups that are placed perpendicular to the strings.

The auxiliary electromagnetic pickup 120 is coupled to an auxiliary output jack 140. This auxiliary output jack 140 is for coupling the auxiliary electromagnetic pickup 120 to an effects unit, such as an octave pedal. The effects unit is further coupled to an auxiliary amplifier (shown in FIG. 3).

FIG. 1 shows the auxiliary electromagnetic pickup 120 affixed to the body 110 of the stringed musical instrument 100. The present invention, however, also contemplates a configuration with the auxiliary electromagnetic pickup 120 not being affixed to the body 110 of the stringed musical instrument 100.

As further shown in FIG. 1, the stringed musical instrument 100 can have a standard electromagnetic pickup 130 beneath and longitudinally perpendicular to the strings 180 of the stringed musical instrument 100. This standard electromagnetic pickup 130 is coupled to a standard output jack 150. The standard output jack 150 is for coupling the standard electromagnetic pickup 130 to a standard amplifier (shown in FIG. 3).

Further, the present invention contemplates having an auxiliary knob 160 that couples to the auxiliary electromagnetic pickup 120. The auxiliary knob 160 will allow the user to adjust the signals that are produced by the auxiliary electromagnetic pickup 120. This will allow the user to adjust the sounds that are eventually produced by the auxiliary amplifier (shown in FIG. 3).

The auxiliary knob 160 allows the user to adjust the signals (volume/tone) that are produced by the auxiliary electromagnetic pickup 120. This will allow the user to adjust and control the sounds that are eventually produced by the auxiliary amplifier (shown in FIG. 3).

Similarly, the present invention contemplates having a standard knob 170 that couples to the standard electromagnetic pickup 130. The standard knob will allow the user to adjust the signals (volume/tone) that are produced by the standard electromagnetic pickup 130. This will allow the user to adjust and control the sounds that are eventually produced by the standard amplifier (shown in FIG. 3). Further, this ability to adjust and control the sounds produced by the standard amplifier (shown in FIG. 3) is independent from the user's ability to control the sounds produced by the auxiliary amplifier (shown in FIG. 3).

According to a preferred embodiment of the present invention, the stringed musical instrument 100 is fitted with an auxiliary pre-amplifier circuit (not shown). The auxiliary pre-amplifier circuit couples to the auxiliary electromagnetic pickup 120. Once the auxiliary electromagnetic pickup 120 is coupled to the auxiliary pre-amplifier circuit, the auxiliary output jack 140 would receive signals from the auxiliary electromagnetic pickup 120 by way of the auxiliary pre-amplifier circuit.

Preferably, the auxiliary pre-amplifier circuit is located within the body 110 of the stringed musical instrument 100.

The strings 180 of the stringed musical instrument can be made from various materials including, but not limited to, nickel, copper, steel, bronze, silk, and nylon. Additionally, the strings 180 could be made from an alloy produced by the combination of any of the aforementioned materials.

Further, the present invention envisions the auxiliary electromagnetic pickup 120 with a magnetic core, the magnetic core being constructed from material including, but not limited to, ceramic, aluminum nickel cobalt, samarium cobalt, and neodymium boron iron.

Figure 2:
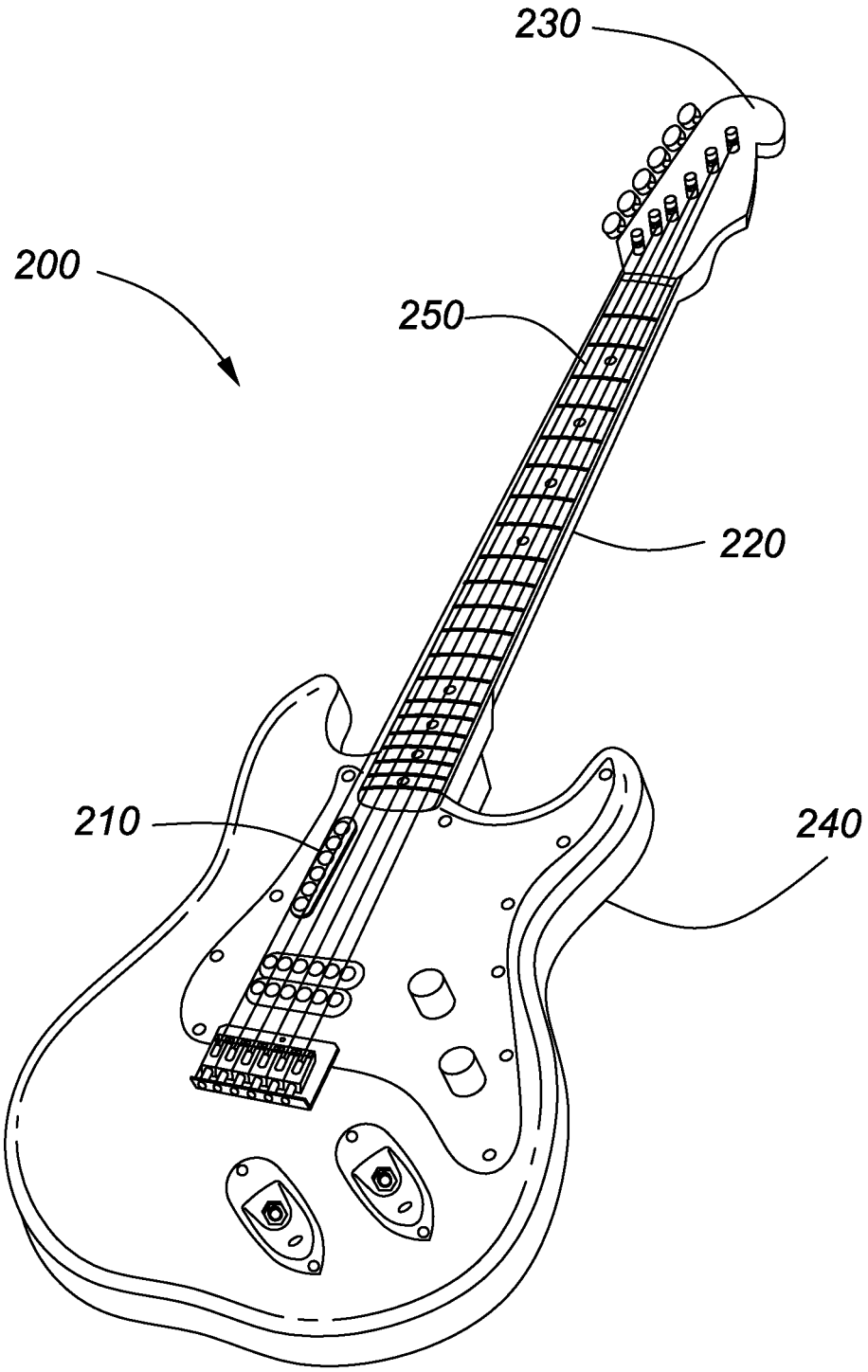
FIG. 2 is a stringed musical instrument with an auxiliary pickup beneath and longitudinally parallel to one string according to another embodiment of the present invention.

FIG. 2 shows a stringed musical instrument according to another embodiment of the present invention. Specifically, FIG. 2 shows a stringed musical instrument in the form of an electric guitar 200. The body 240 is connected to the neck 220, which is in turn connected to the head 230. An auxiliary electromagnetic pickup 210 is shown beneath and longitudinally parallel to one string 250 of the electric guitar 200.

The auxiliary electromagnetic pickup 210 is coupled to an auxiliary output jack (shown in FIG. 1). The configuration and pre-amplifier circuitry setup of the electric guitar 200 with the auxiliary electromagnetic pickup 210 is similar to the setup as described above with reference to FIG. 1.

Although FIG. 2 shows a configuration using a body 240, neck 220, and head 230 of an electric guitar 200, a potential alternative configuration of a stringed musical instrument uses no body, no neck, and no head of any type.

Additionally, although FIG. 2 shows a configuration using a body 240, neck 220, and head 230 of an electric guitar 200, the present invention also contemplates a configuration of a stringed musical instrument that uses other parts from different stringed musical instruments besides a guitar.

Further, although FIG. 2 shows the auxiliary electromagnetic pickup 210 beneath and longitudinally parallel to only one string 250 of the electric guitar 200, the auxiliary electromagnetic pickup 210 can be placed beneath and longitudinally parallel to multiple strings.

Figure 3:
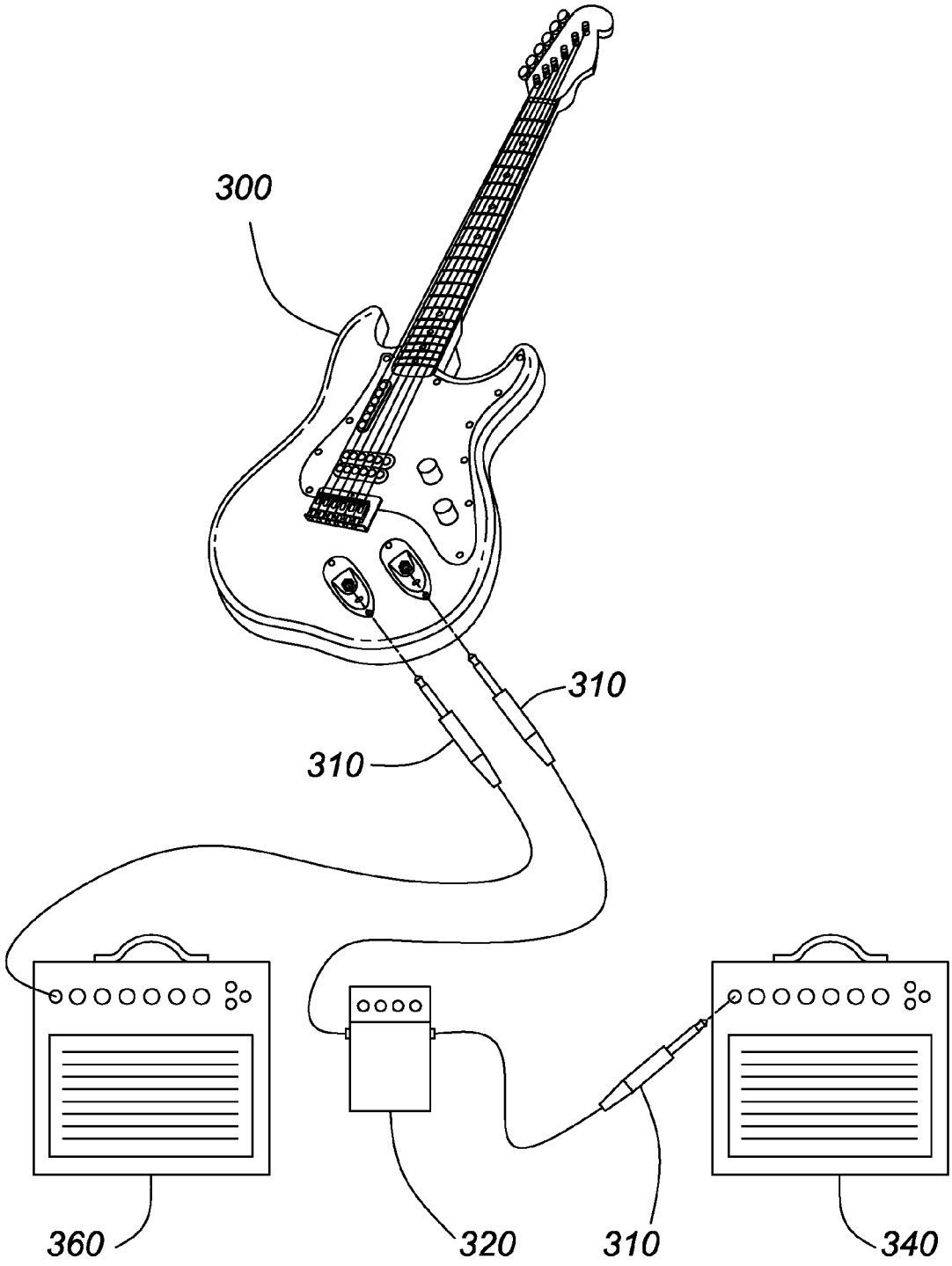
FIG. 3 illustrates a stringed musical instrument that is connected to two amplifiers according to a further embodiment of the present invention.

FIG. 3 shows a stringed musical instrument 300 that is connected to a standard amplifier 360 and an auxiliary amplifier 340 according to a further embodiment of the present invention. The stringed musical instrument 300 is connected by way of a standard cable 310 to the auxiliary amplifier 340. Similarly, the stringed musical instrument 300 is connected by way of a standard cable 310 to a standard amplifier 360.

Having the octave pedal 320 coupled to the stringed musical instrument 300 and auxiliary amplifier 340 gives the user greater control of tones produced by certain strings.

The octave pedal 320 is a special type of effects unit which allows the user to modify the sound of a played note. It allows for the played note to be coupled and mixed with a generated note one octave lower or higher than the original note played.

In a preferred embodiment, the auxiliary electromagnetic pickup (shown in FIG. 1) is placed beneath and longitudinally parallel to the bass strings (E and A notes) of the guitar. For a differently stringed and tuned guitar, the present invention envisions the auxiliary electromagnetic pickup placed parallel to and beneath the thickest strings of the guitar. By placing the auxiliary electromagnetic pickup in the vicinity of the bass strings, the octave pedal 320 only enhances the bass notes. This gives the user enhanced musical control of the bass notes while playing the guitar. In one use of the invention, the user can accompany himself using the enhanced bass notes. In certain circumstances, this omits the need for a separate bass player.

Having the stringed musical instrument 300 independently couple to both an auxiliary amplifier 340 and a standard amplifier 360 allows the user to independently adjust and control the signals produced by each of the auxiliary electromagnetic pickup (shown in FIG. 1) and the standard electromagnetic pickup (also shown in FIG. 1). The user would be able to adjust and control each of the auxiliary electromagnetic pickup (shown in FIG. 1) and the standard electromagnetic pickup (shown in FIG. 1) with the use of the auxiliary knob (shown in FIG. 1) and the standard knob (shown in FIG. 1). This configuration allows for greater control of tones produced by certain strings than the control provided by the single standard output jack configuration found on standard stringed musical instruments.

The embodiment of the present invention shown in FIG. 3 shows an octave pedal 320 being used only in conjunction with the auxiliary amplifier 340 and the auxiliary output jack (shown in FIG. 1). The present invention also contemplates, however, using the octave pedal 320 in conjunction with the standard amplifier 360 and the standard output jack (shown in FIG. 1).

It should be noted that the stringed instrument discussed above may be an electric instrument (e.g. an electric guitar) or it may be an acoustic instrument (e.g. an acoustic guitar). For an electric instrument such as an electric guitar, the auxiliary electromagnetic pickups may be configured as an add-on to the standard pickups present in modern electric guitars or they may be configured as being embedded with the electric guitar along with the standard pickups. For the acoustic instruments, the auxiliary pickups may be attachable to the acoustic instrument in the manner described above so that only the output of certain strings is picked up.

A person understanding this invention may now conceive of alternative structures and embodiments or variations of the above all of which are intended to fall within the scope of the invention as defined in the claims that follow.

What is claimed is:

1. A stringed musical instrument comprising:

at least one string;

at least one auxiliary electromagnetic pickup beneath and longitudinally parallel to the at least one string;

at least one auxiliary output jack that is coupled to the at least one auxiliary electromagnetic pickup, wherein the auxiliary output jack is for coupling to at least one amplifier, and wherein the at least one auxiliary output jack receives signals from the at least one auxiliary electromagnetic pickup;

at least one standard electromagnetic pickup that is beneath and longitudinally perpendicular to the at least one string; and at least one standard output jack that is coupled to the at least one standard electromagnetic pickup, wherein the standard output jack is for coupling to at least one amplifier, and wherein the at least one standard output jack receives signals from the at least one standard electromagnetic pickup.

2. The stringed musical instrument as in claim 1 further comprising:

at least one auxiliary pre-amplifier circuit that is coupled to the at least one auxiliary electromagnetic pickup, wherein the at least one auxiliary output jack receives signals from the at least one auxiliary electromagnetic pickup by way of the at least one auxiliary pre-amplifier circuit.

3. The stringed musical instrument as in claim 1, wherein the at least one string is constructed from a material comprising at least one of: nickel, copper, steel, bronze, silk, and nylon.

4. The stringed musical instrument as in claim 1, wherein the at least one auxiliary electromagnetic pickup is constructed from a material comprising at least one of: ceramic, aluminum nickel cobalt, samarium cobalt, and neodymium boron iron.

5. The stringed musical instrument as in claim 1, further comprising:

at least one knob coupled to the at least one auxiliary electromagnetic pickup, wherein the knob is for adjusting signals produced by the at least one auxiliary electromagnetic pickup.

6. The stringed musical instrument as in claim 1, further comprising:

at least one standard pre-amplifier circuit that is coupled to the at least one standard electromagnetic pickup, wherein the at least one standard output jack receives signals from the at least one standard electromagnetic pickup by way of the at least one standard pre-amplifier circuit.

7. A stringed musical instrument comprising:

a body;

a neck connected to the body;

at least one string;

at least one auxiliary electromagnetic pickup affixed to the guitar body, wherein the auxiliary electromagnetic pickup is beneath and longitudinally parallel to the at least one string;

at least one auxiliary output jack that is coupled to the at least one auxiliary electromagnetic pickup, wherein the auxiliary output jack is for coupling to at least one amplifier, and wherein the at least one auxiliary output jack receives signals from the at least one auxiliary electromagnetic pickup;

at least one standard electromagnetic pickup that is beneath and longitudinally perpendicular to the at least one string; and at least one standard output jack that is coupled to the at least one standard electromagnetic pickup, wherein the standard output jack is for coupling to at least one amplifier, and wherein the at least one standard output jack receives signals from the at least one standard electromagnetic pickup.

8. The stringed musical instrument as in claim 7, further comprising:

at least one auxiliary pre-amplifier circuit that is coupled to the at least one auxiliary electromagnetic pickup, wherein the at least one auxiliary output jack receives signals from the at least one auxiliary electromagnetic pickup by way of the at least one auxiliary pre-amplifier circuit.

9. The stringed musical instrument as in claim 7, wherein the at least one string is constructed from a material comprising at least one of: nickel, copper, steel, bronze, silk, and nylon.

10. The stringed musical instrument as in claim 7, wherein the at least one parallel electromagnetic pickup is constructed from a material comprising at least one of: ceramic, aluminum nickel cobalt, samarium cobalt, and neodymium boron iron.

11. The stringed musical instrument as in claim 8, wherein the auxiliary pre-amplifier circuit is located within the body.

12. The stringed musical instrument as in claim 7, wherein the auxiliary output jack is affixed to the body.

13. The stringed musical instrument as in claim 7, further comprising:

at least one knob coupled to the at least one auxiliary electromagnetic pickup, wherein the knob is for adjusting signals produced by the at least one auxiliary electromagnetic pickup.

14. The stringed musical instrument as in claim 13, wherein the knob is affixed to the body.

15. The stringed musical instrument as in claim 7, further comprising:

at least one standard pre-amplifier circuit that is coupled to the at least one standard electromagnetic pickup, wherein the at least one standard output jack receives signals from the at least one standard electromagnetic pickup by way of the at least one standard pre-amplifier circuit.

16. The stringed musical instrument as in claim 15, wherein the standard pre-amplifier circuit is located within the body.

17. The stringed musical instrument as in claim 1, further including at least one effects unit, for coupling the at least one effects unit to the auxiliary output jack and the at least one amplifier, to modify signals received by the auxiliary output jack.

18. The stringed musical instrument as in claim 7, further including at least one effects unit, for coupling the at least one effects unit to the auxiliary output jack and the at least one amplifier, to modify signals received by the auxiliary output jack.

* * * * *